US005299484A

United States Patent [19]

Ishida et al.

[11] Patent Number: 5,299,484

[45] Date of Patent: Apr. 5, 1994

[54] BEARING STRUCTURE AND TRANSMISSION STRUCTURE IN PIANO

[75] Inventors: Muneo Ishida; Mituo Yamashita, both of Shizuoka; Masanari Onishi; Masahiro Tanaka, both of Hyogo, all of Japan

[73] Assignee: Kawai Musical Instrument Manufacturing Co., Ltd., Shizuoka, Japan

[21] Appl. No.: 30,840

[22] Filed: Mar. 12, 1993

[30] Foreign Application Priority Data

Mar. 27, 1992 [JP] Japan ..... 4-071209

[51] Int. Cl.[5] ..... G10C 3/18; G10C 3/00

[52] U.S. Cl. ..... 84/251; 84/452 P

[58] Field of Search ..... 84/251, 250, 452 R, 84/452 P

[56] References Cited

U.S. PATENT DOCUMENTS 3,583,271 6/1971 Corwin ..... 84/452 P 3,730,963 5/1973 Imagawa ..... 84/251

4,840,104 6/1989 Ishida et al. ..... 84/452 P

*Primary Examiner*—Michael Gellner

*Assistant Examiner*—Cassandra C. Spyrou

*Attorney, Agent, or Firm*—Flynn, Thiel, Boutell & Tanis

[57] ABSTRACT

A bearing structure in a piano action part which can always maintain the torque of rotation of a pin shaft supporting a hammer member within a predetermined range characterized in that the bearing structure comprises a pin shaft fixed to a hammer member, a support member having through-holes through which the pin shaft passes and cloth members with which the spaces between the through-holes and the pin shaft inserted through the through-hole are packed, and that the support member is made of a cellulose derivative resin composition containing silica having a number of silanol groups of 3.0 or less per 100 square Å and a BET specific surface area of 100 to 210 $m^2/g$, and a transmission structure in a piano characterized in that the transmission structure comprises a hammer member and the above-mentioned bearing structure.

2 Claims, 4 Drawing Sheets

BEARING STRUCTURE AND TRANSMISSION STRUCTURE IN PIANO

BACKGROUND OF THE INVENTION

1. Field of the Invention

The present invention relates to a bearing structure and a transmission structure in a piano.

DESCRIPTION OF THE RELATED ART

A transmission structure in a piano, that is, an action part of a piano, exists between a key of a keyboard and a string in a drum, consists of a bearing structure and a hammer member, and transmits the motion of the key to a string. Namely, when the motion of the key is transmitted to the hammer member through the bearing structure, the hammer member rotates, and the hammer head of the hammer member strikes a string.

Figure 1:
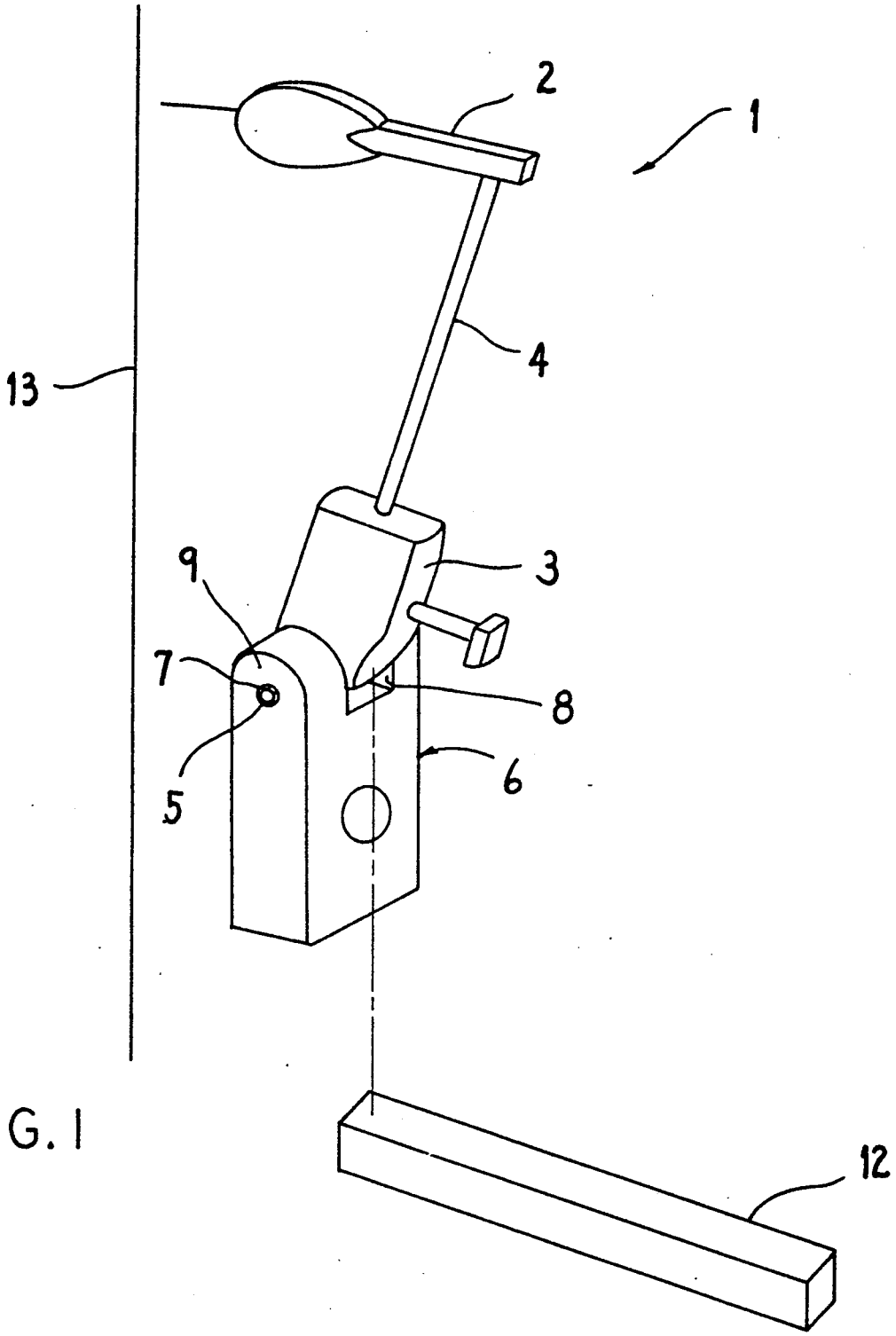
FIG. 1 is a perspective view showing a key, a transmission structure according to the present invention and a string in a piano.
Figure 3:
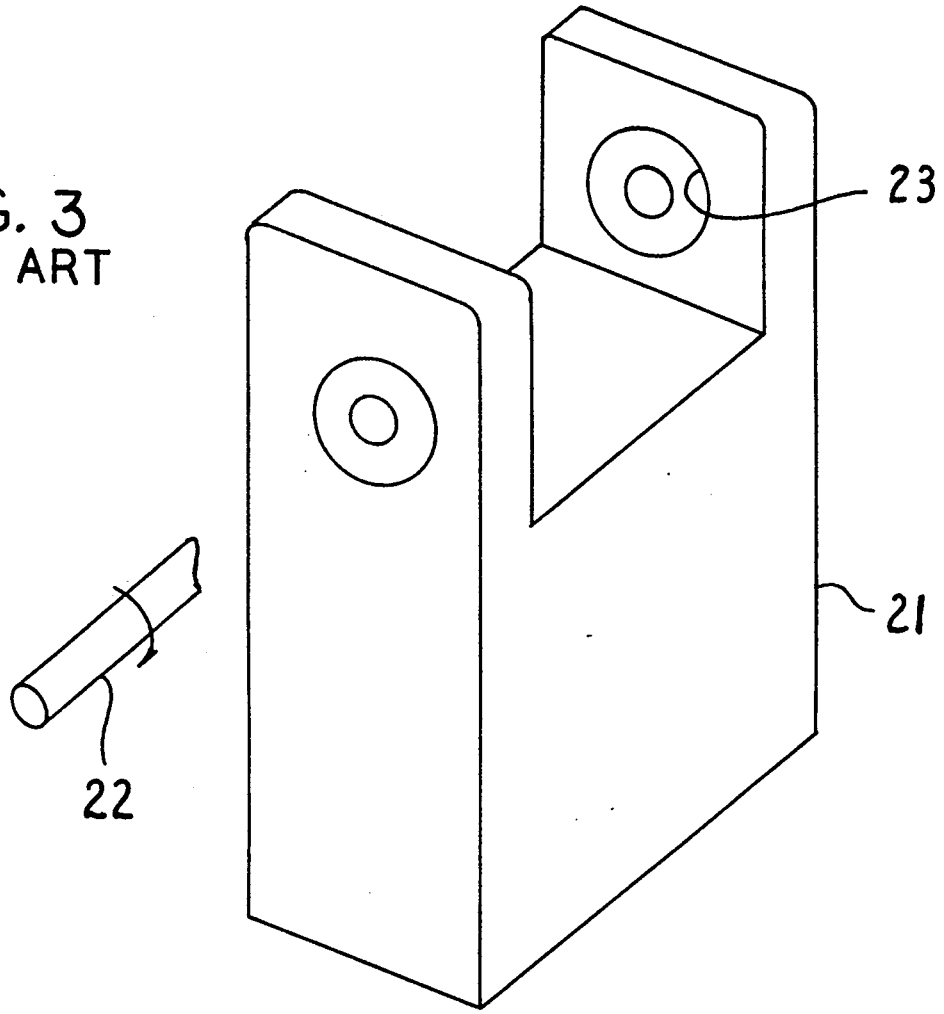
FIG. 3 PRIOR ART
FIG. 3 is a perspective view of a conventional support member.
Figure 4:
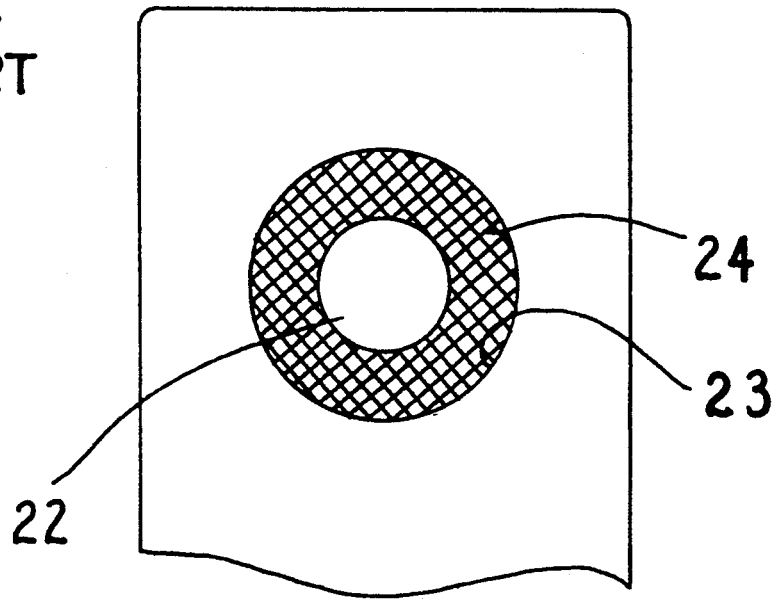
FIG. 4 PRIOR ART
FIG. 4 is a partially enlarged view of the conventional support member.

The hammer member is supported by a bearing structure consisting of a support member generally called "frenge", a cloth member and a pin shaft. An example of conventional bearing structures is shown in FIGS. 3 and 4. The support member, that is, a butt frenge 21, has through-holes 23 through which a pin shaft, that is, a center pin 22, is inserted. The center pin 22 which has a nickel plating layer is fixed to a hammer butt 3 of the hammer member 1 as shown in FIG. 1. The space between the through-hole 23 and the center pin 22 is packed with a cloth member (fabric) 24 without any gap as shown in FIG. 4, and the cloth member 24 is fixed on the through-hole 23 side. The center pin 22 rotates inside the through-holes 23 with the rotation of the hammer member 1.

Conventionally, the support member, that is, a butt frenge 21, is made of wood. Wood has anisotropy and its change ratio is different between the direction of grain and its vertical direction thereof (See Wood Preservation Handbook, p.p. 473–477, "Deformation of a lumber with the change of moisture content"). When the wood of the butt frenge 21 absorbs moisture, the diameters of the through-holes 23 bored in the butt frenge 21 change. The result of the measurement conducted by the present inventors shows that the wood undergoes shrinkage of 2.5% in the direction of grain but expands 0.6% in the vertical direction. Namely, the through-holes undergo elliptic deformation. On the other hand, the cloth members 24 fixed to the through-holes 23 uniformly expand due to moisture absorption. As a result, the center pin 22 receives a pushing force resulting from the reduction of the diameter in the direction of grain and from the expansion of the cloth members, and the torque of rotation rises.

SUMMARY OF THE INVENTION

The present invention aims at providing a novel bearing structure and a novel transmission structure which are free from the problem that the torque of rotation of a pin shaft rises when a support member absorbs moisture.

The present invention provides a bearing structure in a piano action part characterized in that the bearing structure comprises a pin shaft fixed to a hammer member, a support member having through-holes through which the pin shaft passes and cloth members with which the spaces between the through-holes and the pin shaft inserted through the through-hole are packed, and that the support member is made of a cellulose derivative resin composition containing silica having a number of silanol groups of 3.0 or less per 100 square Å and a BET specific surface area of 100 to 210 $m^2/g$.

Namely, in a piano action part for transmitting motion of a key of a piano keyboard to a hammer member to rotate the hammer member and to cause it to strike a string, the bearing structure in the piano action part according to the present invention is characterized in that the bearing structure for pivotally supporting the hammer member comprises a pin shaft fixed to the hammer member, a support member having through-holes through which the pin shaft passes and cloth members with which the spaces between the through-holes and the pin shaft inserted through the through-holes are packed, and the support member is made of a cellulose derivative resin, i.e., a cellulose derivative resin composition, containing silica having a number of silanol groups of 3.0 or less per 100 square Å and a BET specific surface area of 100 to 210 $m^2/g$.

The present invention also provides a transmission structure in a piano characterized in that the transmission structure comprises a hammer member and a bearing structure comprising a pin shaft fixed to the hammer member, a support member having through-holes through which the pin shaft passes and cloth members with which the spaces between the through-holes and the pin shaft inserted through the through-hole are packed, and that the support member is made of a cellulose derivative resin composition containing silica having a number of silanol groups of 3.0 or less per 100 square Å and a BET specific surface area of 100 to 210 $m^2/g$.

DETAILED DESCRIPTION OF THE INVENTION

The bearing structure of the present invention comprises a pin shaft fixed to a hammer member, a support member having through-holes through which the pin shaft is inserted, and cloth members with which the spaces between the through-hole and the pin shaft are packed, and the support member is made of a cellulose derivative resin composition containing a specific silica.

The transmission structure, that is, the piano action part, of the present invention comprises a hammer member and the bearing structure of the present invention. The hammer member generally consists of a hammer butt, a hammer shank fixed to one of the ends of the hammer butt and a hammer head fixed to the tip of the hammer shank.

The hammer member is supported by the support member through the pin shaft and the cloth members, and rotates round the pin shaft to strike a string. The pin shaft comes into sliding contact with the cloth members with the rotation of the hammer member and rotates inside the through-holes. In this way, the hammer member is pivotally supported by this bearing structure.

The support member according to the present invention is made of a cellulose derivative resin composition comprising a cellulose derivative resin and a specific silica.

Though cellulose acetate resin is preferable as this cellulose derivative resin, cellulose acetate propionate resin and cellulose acetate butylate resin, in addition to cellulose acetate resin, can also be cited as the cellulose derivative resin.

The cellulose derivative resin according to the present invention has hygroscopicity, and the diameters of the through-holes bored in the support member made of a resin composition comprising the cellulose derivative resin according to the present invention increase uniformly in all directions at the time of absorption of moisture. Further, the cellulose derivative resin and the cellulose derivative resin composition according to the present invention is tough and is excellent in processability. Furthermore, the cellulose derivative resin absorbs much more remarkably sounds of 3,000 HZ or above in comparison with other thermoplastic resins. The cellulose derivative resin composition which is prepared by adding a specific silica as an inorganic filler to the cellulose derivative resin has a further improved and increased hardness compared with that of the cellulose derivative resin.

The silica, i.e., the silica particles, used in the present invention must satisfy the condition where the number of silanol groups is 3.0 or less per 100 square Å and the BET specific surface area is 100 to 210 $m^2/g$. Here, the number of silanol groups can be calculated from the specific surface area by steam adsorption according to the following formula:

The number of silanol groups (pcs/100 square Å)=specific surface area ($m^2/g$) by steam adsorption $\times 100 + \{10.6$ [sectional area of water molecule (square Å)]$\times$BET specific surface area ($m^2/g$)} (it is assumed that one water molecule is adsorbed on one silanol group).

When the number of silanol groups exceeds 3.0 , much water is adsorbed on the silica surface. Therefore, many problems such that bubbling occurs while the silica is blended with the cellulose derivative resin and the resulting mixture is heat-melted and kneaded, and that the water promotes hydrolysis of the cellulose derivative resin, occur.

The BET specific surface area can be determined from a nitrogen gas adsorption quantity by a BET method, and the measuring method is stipulated in ASTM D-3037. This BET specific surface area value is used as a substitution value of a basic particle size of silica. When the BET specific surface area value is less than 100 $m^2/g$, the particle size becomes coarse, and when such a silica is blended and the obtained mixture is molded, a flat surface and sufficient hardness cannot be obtained. When the value exceeds 210 $m^2/g$, cohesive force of the silica particles becomes so high that dispersibility of silica into the cellulose derivative resin becomes remarkably inferior.

When the silica according to the present invention is used, a required hardness can be obtained with a smaller amount of addition than when other inorganic fillers are used. Accordingly, the lowering of fluidity becomes smaller and hence, injection moldability becomes better. Since the silanol groups remain on the surface of this silica and this silica has hygroscopicity, a synegistic effect can be obtained without lowering the hygroscopicity of the cellulose derivative resin by blending the silica to the cellulose derivative resin.

The cellulose derivative resin composition according to the present invention may contain a plasticizer. In particular, when a cellulose acetate resin is employed as the cellulose derivative resin, a plasticizer is usually used. Representative examples of the plasticizer include phthalates such as dimethyl phthalate, diethyl phthalate and dibutyl phthalate. The amount of the plasticizer is most suitably 20 to 50 parts by weight per 100 parts by weight of cellulose acetate flakes as the raw material in the case of an injection molding material. When the amount of the plasticizer added is less than 20 parts by weight, the flowability is notably lowered, leading to a difficulty in injection molding, and the molding temperature is inevitably so increased that deterioration and coloration of the resin composition are liable to occur. When it exceeds 50 parts by weight, the flowability is improved but the resin composition itself is softened and hence the amount of silica must be increased to improve the hardness, leading to a decrease in impact strength.

The silica-containing cellulose derivative resin composition according to the present invention may contain, if necessary, usual amounts of usual thermal stabilizers for preventing thermal deterioration, such as a weak organic acid, an epoxy compound, a phosphite, a thioether phosphite, a phenol derivative, a thiophosphite, an imidazole compound, an amine derivative, a metallic soap, a dyestuff and a pigment.

Furthermore, the support member consisting of the cellulose derivative resin composition according to the present invention may have a surface hardness (in terms of a durometer hardness) of 82 or more, advantageously. The durometer hardness in the present invention is D hardness as stipulated in JIS K 7215. In order to obtain a surface hardness of 82 or more in terms of durometer hardness, 15 parts by weight or more of the above-specified silica must be blended with 100 parts by weight of the cellulose derivative resin.

In the present invention, the hammer member may be made of a conventional material, the pin shaft may be made of, for example, brass or a material having a nickel plating layer, and the cloth member may be made of, for example, 100% wool.

The cloth members according to the present invention uniformly expand upon absorbing moisture. The support member according to the present invention has hygroscopicity and the diameters of the through-holes uniformly increase when it absorbs moisture. Accordingly, the changes of both of them are offset, so that the change of the diameters of the holes through which the pin shaft is inserted is small, and eventually, the change of torque of rotation of the pin shaft can be avoided.

EMBODIMENT

Hereinafter, an embodiment of the present invention will be explained with reference to the drawings.

Figure 2:
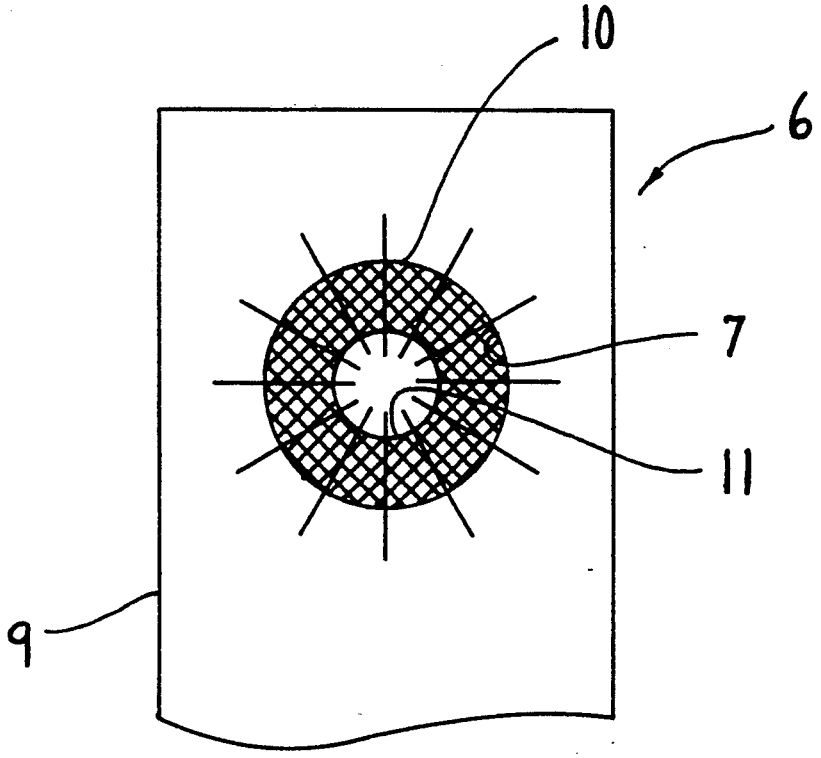
FIG. 2 is a partially enlarged view of the support member according to the present invention.

FIG. 1 is a perspective view showing a key, a transmission structure according to the present invention and a string in a piano. The hammer member 1 comprises a substantially rectangular sheet-like hammer butt 3, a rod-like hammer shank 4 fixed to one of the ends of this hammer butt 3 and a hammer head 2 fixed to the tip of the hammer shank 4. The center pin 5 penetrates through the hammer butt 3 and is fixed at both side surfaces of the hammer butt 3. The center pin 5 is inserted through through-holes 7 formed in the support member, that is, a but frenge 6. The butt frenge 6 is a rectangular member which is sharped and has a curved surface at one of the ends thereof, and a notch 8 is formed in a longitudinal direction at the center of this curved surface. This notch 8 defines bearing parts 9 opposing each other while sandwiching the notch 8 between them. As shown in FIG. 2, the through-holes 7 are bored in this bearing parts 9, and have a diameter greater than that of the center pin 5. Cloth members 10 are fixed to the through-holes 7. The cloth members 10 are ring-like fabric members, and the center pin 5 fits into the center holes 11. For example, the diameter of the through-hole 7 is 2.5 mm, the diameter of the center pin 5 is from 1.25 to 1.35 mm and the thickness of the cloth members 10 is 1.3 mm. The hammer member 1 is supported in this way by the butt frenge 6 through the center pin 5 and the cloth members 10 and rotates round the center pin 5. The center pin 5 comes into sliding contact with the cloth members 10 with the rotation of the hammer member 1, and rotates inside the through-holes 7. When a key 12 is pushed down, the hammer butt 3 is pushed up from below by members interposed between the key 12 and the hammer butt 3 as shown in FIG. 1, so that the hammer member 1 rotates and the hammer head 2 strikes a string 13.

The butt frenge 6 is made of a cellulose derivative resin composition containing a specific silica. This silica satisfies the condition that the number of silanol groups is 3.0 or less per 100 square Å and the BET specific surface area is from 100 to 210 $m^2/g$. The butt frenge 6 has hygroscopicity and the through-holes 7 expand uniformly when the butt frenge 6 absorbs moisture.

Hereinafter, the function of the bearing structure and the transmission structure having the bearing structure of the present invention having such a construction will be explained. In FIG. 2, when the cloth members 10 absorb moisture, the cloth members 10 uniformly expand, so that the diameter of the center holes 11 become smaller. On the other hand, when the butt frenge 6 absorbs moisture, the diameters of the through-holes 7 increase in contrast to the decrease of the diameters of the center holes 11 due to the absorption of moisture by the cloth members 10. In other words, the through-hole 7 expands uniformly in all directions and the cloth member 10 uniformly expands toward the center of the through-hole 7. Accordingly, the changes of both of them are offset, so that the change of the diameter of the center holes 11 through which the center pin 5 passes is small and eventually, the change of the torque of rotation of the center pin 5 can be avoided.

Since the bearing structure and the transmission structure having the bearing structure in a piano according to the present invention has the construction as described above, the torque of rotation of the pin shaft supporting the hammer member is maintained always within a predetermined range, so that a piano can be played always with the same touch and feeling.

The support member according to the present invention can be produced efficiently, easily and economically by an injection molding machine, or the like.

EXPERIMENTAL EXAMPLE

Two kinds of butt frenges made of different materials were produced, each of them was wetted, and the change of each of them is measured. The sizes of the butt frenges used were as follows:

Butt Frenge 26 mm (length)×12 mm (width)×7 mm (thickness);

Bearing Parts 26 mm (length)×2.8 mm (width)×7 mm (thickness); (diameters of the through-holes) 2.5 mm.

The comparison result is tabulated in Table 1 below.

As shown in Table 1, when heated and wetted, expansion of the wooden butt frenge was great in length, width and thickness. In contrast, the change ratio of the butt frenge according to the present invention was ¼ of that of the wooden butt frenge. The change ratio of the diameters of the through-holes was different depending on the directions in the case of the wood. In contrast, the diameters of the through-holes becomes uniformly great irrespective of the direction in the case of the butt frenge of the present invention.

TABLE 1

| material | length, width, thickness*1 | diameters of the through-holes*1 |
|---|---|---|
| wood (maple) | expanded in an amount of 2 to 4% | decreased 2.5% in grain direction and increased 0.6% in direction perpendicular to the grain direction |
| cellulose derivative resin composition containing a specific silica according to the present invention*2 | expanded in an amount of 0.5 to 1% | increased uniformly 0.5% |

*1The sizes were measured in an ordinary state (25° C., 52% RH) and after humidification (25° C., 100% RH, 96 Hrs.). The diameters of the through-holes were measured with a projector.

*2The butt frenge consisting of the resin composition was prepared as follows: 100 parts by weight of cellulose acetate flakes was admixed with 27 parts by weight of a phthalate plasticizer, 0.2 part by weight of an epoxy compound and 0.3 part by weight of an alkyl phosphite as thermal stabilizer, 30 parts by weight of a silica having a number of silanol groups of 2.1 per 100 square Å, a BET specific surface area of 136 $m^2/g$ and an average particle size of 0.9 μm, and 2.5 parts by weight of a white pigment in a universal mixing agitator at 80° C. for 4 hours while drying the mixture so as to provide a water content of 0.2 wt. % or lower. The mixture was melt-kneaded and extruded with an extruder of 40 mm in diameter at 220° C. to form pellets. The butt frenge was molded from these pellets with an injection molding machine.

What we claim is:

1. A bearing structure in a piano action part characterized in that the bearing structure comprises a pin shaft fixed to a hammer member, a support member having through-holes through which the pin shaft passes and cloth members with which the spaces between the through-holes and the pin shaft inserted through the through-hole are packed, and that the support member is made of a cellulose derivative resin composition containing silica having a number of silanol groups of 3.0 or less per 100 square Å and a BET specific surface area of 100 to 210 $m^2/g$.

2. A transmission structure in a piano characterized in that the transmission structure comprises a hammer member and a bearing structure comprising a pin shaft fixed to the hammer member, a support member having through-holes through which the pin shaft passes and cloth members with which the spaces between the through-holes and the pin shaft inserted through the through-hole are packed, and that the support member is made of a cellulose derivative resin composition containing silica having a number of silanol groups of 3.0 or less per 100 square Å and a BET specific surface area of 100 to 210 $m^2/g$.

* * * * *